US012414643B2

(12) United States Patent
Babik

(10) Patent No.: US 12,414,643 B2
(45) Date of Patent: Sep. 16, 2025

(54) HINGED DISPLAY FRAME FOR A GREETING CARD

(71) Applicant: Brian Babik, Pittsburgh, PA (US)

(72) Inventor: Brian Babik, Pittsburgh, PA (US)

( * ) Notice: Subject to any disclaimer, the term of this patent is extended or adjusted under 35 U.S.C. 154(b) by 205 days.

(21) Appl. No.: 18/329,670

(22) Filed: Jun. 6, 2023

(65) Prior Publication Data

US 2023/0389726 A1 Dec. 7, 2023

Related U.S. Application Data

(60) Provisional application No. 63/350,019, filed on Jun. 7, 2022.

(51) Int. Cl.

| | |
|---|---|
| ***A47G 1/06*** | (2006.01) |
| ***A47G 1/14*** | (2006.01) |
| ***A47G 1/16*** | (2006.01) |

(52) U.S. Cl.

CPC ..... *A47G 1/06* (2013.01); *A47G 1/143* (2013.01); *A47G 1/162* (2013.01); *A47G 2001/0672* (2013.01)

(58) Field of Classification Search

CPC ..... A47G 1/06; A47G 1/143; A47G 1/162; A47G 2001/0672; A47G 1/142; A47G 2001/0677; A47G 2001/0694

See application file for complete search history.

(56) References Cited

U.S. PATENT DOCUMENTS

| | | | | |
|---|---|---|---|---|
| 2,394,980 | A | 2/1946 | Byck | |
| 4,012,858 | A | 3/1977 | McGregor | |
| 4,326,349 | A | 4/1982 | Daughtry | |
| 5,318,327 | A * | 6/1994 | Daneshvar | B42D 15/045 283/117 |
| 5,375,351 | A | 12/1994 | King et al. | |
| D364,042 | S | 11/1995 | Chavez et al. | |
| 5,533,288 | A | 7/1996 | Lambert | |
| 5,575,094 | A | 11/1996 | Leake et al. | |
| 5,635,265 | A * | 6/1997 | Potokar | G09F 1/12 428/33 |
| 5,772,349 | A | 6/1998 | Tubergen | |
| 5,822,897 | A | 10/1998 | Ertzan | |
| 5,979,942 | A | 11/1999 | Ivicic | |
| 6,438,883 | B1 | 8/2002 | Kacius | |
| 6,679,032 | B2 | 1/2004 | Gerrie | |
| 6,845,582 | B1 * | 1/2005 | Ho | A47G 1/06 40/721 |
| 7,100,317 | B1 | 9/2006 | Strong | |
| 7,415,786 | B2 | 8/2008 | Boydston | |
| 8,341,862 | B1 * | 1/2013 | Gunther | A47G 1/06 229/72 |
| 8,613,155 | B1 * | 12/2013 | Gunther | G09D 3/02 229/72 |
| 8,870,061 | B2 | 10/2014 | Beadles et al. | |
| 8,950,093 | B2 | 2/2015 | Mandelbaum et al. | |
| 9,849,712 | B2 | 12/2017 | McClain | |
| 10,111,541 | B2 | 10/2018 | Wong | |
| 10,573,203 | B2 | 2/2020 | Kershner et al. | |

(Continued)

*Primary Examiner* — Gary C Hoge
(74) *Attorney, Agent, or Firm* — The Webb Law Firm

(57) ABSTRACT

A display frame for a card includes a frame, an insert removably connectable to the frame, and a holder having a first panel hingedly connected to a second panel. The first panel is removably received within the insert and the second panel is movable relative to the first panel.

20 Claims, 15 Drawing Sheets

(56) References Cited

U.S. PATENT DOCUMENTS

| | | | | |
|---|---|---|---|---|
| 10,636,389 | B2 | 4/2020 | Gilbert et al. | |
| 2003/0177684 | A1 | 9/2003 | Irwin | |
| 2005/0001420 | A1* | 1/2005 | Gordon | B42D 3/126 281/33 |
| 2006/0070287 | A1 | 4/2006 | Shaw | |
| 2006/0162213 | A1 | 7/2006 | Einarson | |
| 2007/0062080 | A1 | 3/2007 | Bramhall | |
| 2007/0089344 | A1* | 4/2007 | Ting | A47G 1/143 40/754 |
| 2007/0289184 | A1 | 12/2007 | Cheng | |
| 2008/0022567 | A1 | 1/2008 | Marotta et al. | |
| 2009/0025266 | A1* | 1/2009 | Lambert | A47G 1/0605 40/773 |
| 2011/0088294 | A1 | 4/2011 | Docking | |
| 2012/0297650 | A1 | 11/2012 | Burley | |
| 2013/0126598 | A1 | 5/2013 | Beadles et al. | |
| 2013/0276337 | A1* | 10/2013 | Gorham, Jr. | A47G 1/0616 40/124.5 |
| 2017/0100502 | A1* | 4/2017 | Jean | A61L 9/12 |
| 2019/0269262 | A1* | 9/2019 | Kacius | A47G 1/1613 |
| 2020/0039737 | A1 | 2/2020 | Lopez et al. | |
| 2020/0193874 | A1 | 6/2020 | Kershner et al. | |
| 2021/0086543 | A1* | 3/2021 | Salatandre | B42D 15/045 |
| 2022/0322848 | A1* | 10/2022 | Patell | A47G 1/17 |
| 2023/0145688 | A1* | 5/2023 | Hill | A47G 1/1606 40/713 |
| 2024/0206651 | A1* | 6/2024 | Lambert | A47G 1/06 |

* cited by examiner

HINGED DISPLAY FRAME FOR A GREETING CARD

CROSS-REFERENCE TO RELATED APPLICATIONS

This application claims the benefit of U.S. Provisional Application No. 63/350,019 filed on Jun. 7, 2022, entitled "Hinged Display Frame for a Greeting Card", the entirety of which is incorporated herein by reference.

BACKGROUND

Field of the Disclosure

The present disclosure relates to a display frame, and more particularly, to a display frame for a greeting card, which allows for multiple modes of display and storage of cards including bi-fold cards, greeting cards, postcards, photographs, and the like.

Description of Related Art

Frames for greeting cards have been developed in the past. However, these conventional frames are typically made from cardboard material. This type of frame does not provide any form of protection to the displayed card. Further, conventional frames do not allow the card to open to view the inside of the card. Hence, an improved frame for greeting cards is desired which protects the card from being damaged and which allows the card to open to view the message on the inside of the card.

SUMMARY

Accordingly, aspects of the present disclosure are directed to non-limiting embodiments of a display frame for a card.

According to non-limiting embodiments, provided is a display frame for a card, which may include a frame, an insert removably connectable to the frame, and a holder having a first panel hingedly connected to a second panel. The first panel may be removably received within the insert and the second panel may be movable relative to the first panel.

According to some non-limiting embodiments, provided is a display frame for a card, which may include a frame and an insert. The insert may be sized and configured to fit within the frame, and the insert may further include at least two holding components. The display frame may also include a hinged holder. The hinged holder may be sized and configured to hold a card. The hinged holder may also include a first panel and a second panel. A first holding component of the at least two holding components may be configured to hold the first panel of the hinged holder in an upright position, and a second holding component of the at least two holding components may be configured to hold the second panel of the hinged holder in an upright position.

According to some non-limiting embodiments, provided is a display frame for a card, which may include a frame and an insert. The insert may be sized and configured to fit within the frame, and the insert may include a removable backing mechanically fastened to the insert, a recess, at least two slotted holding components, and a storage compartment, which may be configured to store and conceal one or more cards. The display frame may also include a hinged easel back and a hinged holder. The hinged holder may be sized and configured to hold a card. The hinged holder may also include a first panel sized and configured to receive a first portion of a card, and a second panel sized and configured to receive a second portion of a card. A first slotted holding component of the at least two slotted holding components may have a first slot sized and configured to hold the first panel of the hinged holder in an upright position. A second slotted holding component of the at least two slotted holding components having a second slot sized and configured to hold the second panel of the hinged holder in an upright position. The recess of the insert may be configured to removably receive the first panel of the hinged holder.

According to other non-limiting embodiments, provided is a display frame device. The hinge mechanism allows the flap to rotate to an open position and back to a closed position.

Further embodiments are set forth in the following numbered clauses:

Clause 1: A display frame for a card, the display frame comprising: a frame; an insert removably connectable to the frame; and a holder having a first panel hingedly connected to a second panel, wherein the first panel is removably received within the insert and the second panel is movable relative to the first panel.

Clause 2: The display frame of clause 1, wherein the holder is configured to receive a card.

Clause 3: The display frame of clause 1 or 2, wherein the frame and the insert are mechanically fastened via friction fit, one or more magnets, a hook and loop fastener, adhesive, or any combination thereof.

Clause 4: The display frame of any of clauses 1-3, wherein the insert comprises a first surface and a second surface, wherein the first surface comprises a recess configured to removably receive the first panel of the holder.

Clause 5: The display frame of any of clauses 1-4, wherein the recess and the first panel of the holder are mechanically fastened via friction fit, one or more magnets, a hook and loop fastener, adhesive, or any combination thereof.

Clause 6: The display frame of any of clauses 1-5, wherein the second surface comprises at least two holding components configured to attach to wall fasteners when the display frame is attached to a wall defining a first state.

Clause 7: The display frame of any of clauses 1-6, wherein the at least two holding components are further configured to hold the holder in an upright position when the insert is in a horizontal position defining a second state.

Clause 8: The display frame of any of clauses 1-7, wherein the second surface further comprises a hinged easel back configured to hold the display frame in an upright position on a horizontal surface defining a third state.

Clause 9: The display frame of any of clauses 1-8, wherein the insert comprises a storage compartment; and the insert further comprises a removable backing.

Clause 10: The display frame of any of clauses 1-9, wherein the removable backing is mechanically fastened to the insert via friction fit, one or more magnets, a hook and loop fastener, adhesive, or any combination thereof.

Clause 11: The display frame of any of clauses 1-10, wherein the removable backing comprises: at least two holding components, wherein the at least two holding components are configured to attach to wall fasteners when the display frame is attached to a wall defining a first state, and wherein the at least two holding components are further configured to hold the holder in an upright position when the insert is in a horizontal position defining a second state.

Clause 12: The display frame of any of clauses 1-11, wherein the removable backing comprises a hinged easel back configured to hold the display frame in an upright position on a horizontal surface.

Clause 13: The display frame of any of clauses 1-12, wherein the display frame further comprises a hinged easel back configured to hold the display frame in an upright position on a horizontal surface.

Clause 14: The display frame of any of clauses 1-13, wherein the card is a bi-fold card, a greeting card, a postcard, a photograph, or the like.

Clause 15: A display frame for a card, the display frame comprising: a frame; an insert sized and configured to fit within the frame, wherein the insert comprises at least two holding components; and a hinged holder sized and configured to hold a card, wherein the hinged holder having a first panel and a second panel, wherein a first holding component of the at least two holding components is configured to hold the first panel of the hinged holder in an upright position, and wherein a second holding component of the at least two holding components is configured to hold the second panel of the hinged holder in an upright position.

Clause 16: The display frame of clause 15, wherein the at least two holding components comprise a slot.

Clause 17: The display frame of clause 15 or 16, wherein the insert further comprises a storage compartment configured to store and conceal one or more cards.

Clause 18: The display frame of any of clauses 15-17, wherein the holding components are further configured to attach to wall fasteners.

Clause 19: The display frame of any of clauses 15-18, wherein the display frame further comprises a hinged easel back configured to hold the display frame in an upright position on a horizontal surface.

Clause 20: A display frame for a card comprising: a frame; an insert sized and configured to fit within the frame, wherein the insert comprises: a removable backing mechanically fastened to the insert; a recess; at least two slotted holding components; and a storage compartment configured to store and conceal one or more cards; a hinged easel back; a hinged holder sized and configured to hold a card, wherein the hinged holder comprises: a first panel sized and configured to receive a first portion of a card; and a second panel sized and configured to receive a second portion of a card, wherein a first slotted holding component of the at least two slotted holding components having a first slot sized and configured to hold the first panel of the hinged holder in an upright position, wherein a second slotted holding component of the at least two slotted holding components having a second slot sized and configured to hold the second panel of the hinged holder in an upright position, and wherein the recess of the insert is configured to removably receive the first panel of the hinged holder.

Further details and advantages of the various examples described in detail herein will become clear upon reviewing the following detailed description of the various examples in conjunction with the accompanying drawing figures.

BRIEF DESCRIPTION OF THE DRAWINGS

Additional advantages and details are explained in greater detail below with reference to the exemplary embodiments that are illustrated in the accompanying schematic figures, in which:

FIG. 4A shows a back side view of a non-limiting embodiment of an insert of a display frame with a storage compartment in a closed position according to the present disclosure.

FIG. 4B shows a non-limiting embodiment of a removable backing of an insert of a display frame according to the present disclosure.

FIGS. 4C and 4D show back side views of a non-limiting embodiment of an insert of a display frame with a storage compartment in an open position according to the present disclosure.

Corresponding reference characters indicate corresponding parts throughout the several views. The exemplifications set out herein illustrate exemplary embodiments of the disclosure, and such embodiments are not to be construed as limiting the scope of the disclosure in any manner.

DETAILED DESCRIPTION

Figure 1A:
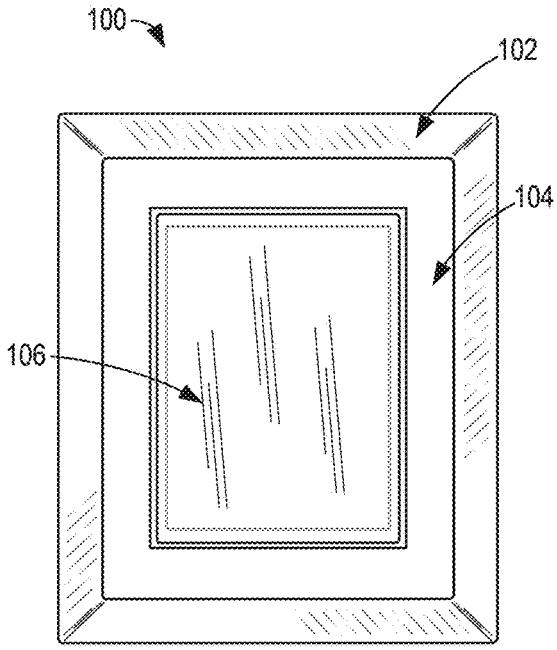
FIG. 1A shows a front side view of a non-limiting embodiment of a display frame with a holder in a closed position according to the present disclosure.

It is to be understood that the present disclosure may assume various alternative variations and step sequences, except where expressly specified to the contrary. It is also to be understood that the specific devices and processes illustrated in the attached drawings, and described in the following specification, are simply exemplary and non-limiting embodiments or aspects. Hence, specific dimensions and other physical characteristics related to the embodiments or aspects disclosed herein are not to be considered as limiting.

For purposes of the description hereinafter, the terms "end," "upper," "lower," "right," "left," "vertical," "horizontal," "top," "bottom," "lateral," "longitudinal," and derivatives thereof shall relate to embodiments or aspects as they are oriented in the drawing figures. However, it is to be understood that embodiments or aspects may assume various alternative variations and step sequences, except where expressly specified to the contrary. It is also to be understood that the specific devices and processes illustrated in the attached drawings, and described in the following specification, are simply non-limiting exemplary embodiments or aspects. Hence, specific dimensions and other physical characteristics related to the embodiments or aspects of the embodiments or aspects disclosed herein are not to be considered as limiting unless otherwise indicated.

No aspect, component, element, structure, act, step, function, instruction, and/or the like used herein should be construed as critical or essential unless explicitly described as such. Also, as used herein, the articles "a" and "an" are intended to include one or more items, and may be used interchangeably with "one or more" and "at least one." As used in the specification and the claims, the singular form of "a," "an," and "the" include plural referents, such as unless the context clearly dictates otherwise. Additionally, as used herein, the terms "set" and "group" are intended to include one or more items (e.g., related items, unrelated items, a combination of related and unrelated items, etc.) and may be used interchangeably with "one or more" or "at least one." Where only one item is intended, the term "one" or similar language is used. Also, as used herein, the terms "has," "have," "having," or the like are intended to be open-ended terms. Further, the phrase "based on" is intended to mean "based at least partially on" unless explicitly stated otherwise.

Embodiments of the present disclosure are directed to a display frame, and more particularly, to a display frame for a greeting card, which allows for multiple modes of display and storage of cards including bi-fold cards, greeting cards, postcards, photographs, and the like.

According to non-limiting embodiments, a display frame for a card may include a frame, an insert removably connectable to the frame, and a holder having a first panel hingedly connected to a second panel. The first panel may be removably received within the insert and the second panel may be movable relative to the first panel. In some non-limiting embodiments, the holder may be configured to receive a card.

In some non-limiting embodiments, the frame and the insert may be mechanically fastened via friction fit, one or more magnets, a hook and loop fastener, adhesive, or any combination thereof.

In some non-limiting embodiments, the insert may include a first surface and a second surface, and the first surface may include a recess configured to removably receive the first panel of the holder. In some non-limiting embodiments, the recess and the first panel of the holder may be mechanically fastened via friction fit, one or more magnets, a hook and loop fastener, adhesive, or any combination thereof. In some non-limiting embodiments, the second surface may include at least two holding components configured to attach to wall fasteners when the display frame is attached to a wall defining a first state. In some non-limiting embodiments, the at least two holding components may be further configured to hold the holder in an upright position when the insert is in a horizontal position defining a second state. In some non-limiting embodiments, the second surface may further include a hinged easel back configured to hold the display frame in an upright position on a horizontal surface defining a third state.

In some non-limiting embodiments, the insert may include a storage compartment, and the insert may further include a removable backing. In some non-limiting embodiments, the removable backing may be mechanically fastened to the insert via friction fit, one or more magnets, a hook and loop fastener, adhesive, or any combination thereof. In some non-limiting embodiments, the removable backing may include at least two holding components. The at least two holding components may be configured to attach to wall fasteners when the display frame is attached to a wall defining a first state, and the at least two holding components may be further configured to hold the holder in an upright position when the insert is in a horizontal position defining a second state. In some non-limiting embodiments, the removable backing may include a hinged easel back configured to hold the display frame in an upright position on a horizontal surface.

In some non-limiting embodiments, the display frame may further include a hinged easel back configured to hold the display frame in an upright position on a horizontal surface.

In some non-limiting embodiments, the card may be a bi-fold card, a greeting card, a postcard, a photograph, or the like.

In this way, embodiments of the present disclosure allow for multiple modes of display and storage of cards including bi-fold cards, greeting cards, postcards, photographs, and the like.

Figure 1B:
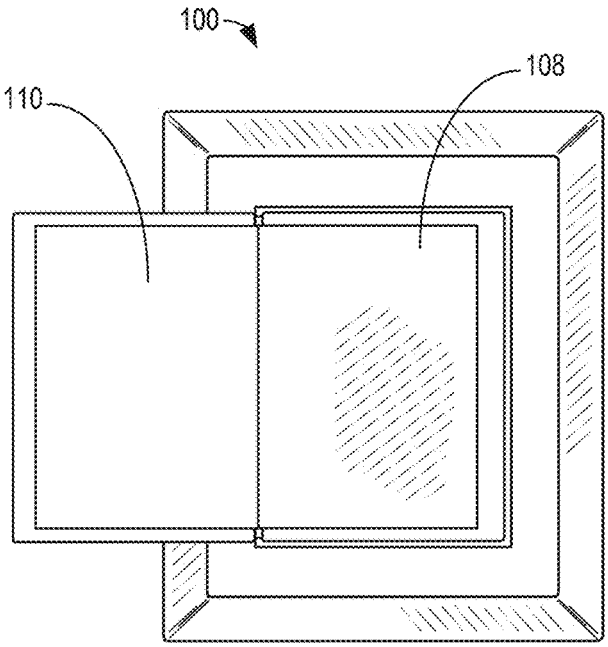
FIG. 1B shows a front side view of a non-limiting embodiment of a display frame with a holder in an open position according to the present disclosure.
Figure 1C:
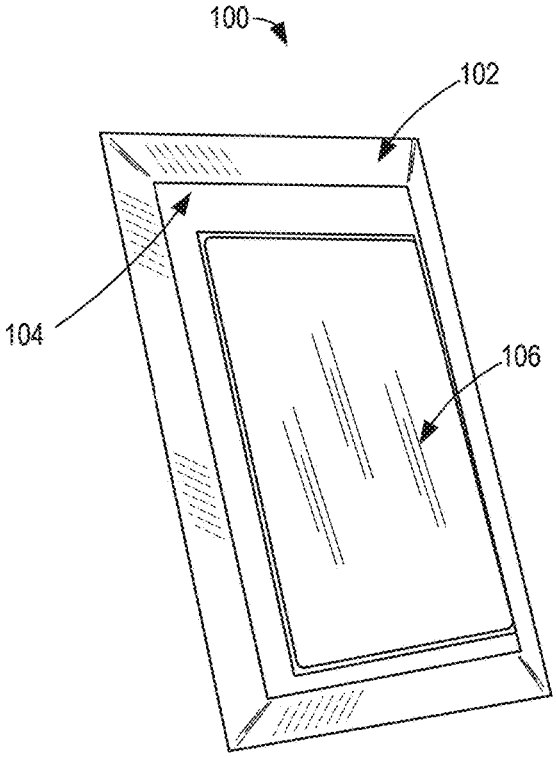
FIG. 1C shows a perspective view of a non-limiting embodiment of a display frame according to the present disclosure.
Figure 2:
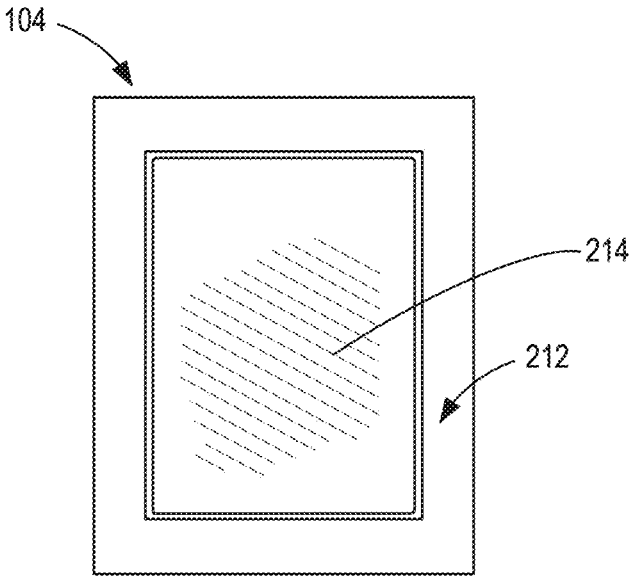
FIG. 2 shows a front side view of a non-limiting embodiment of an insert of a display frame according to the present disclosure.

Referring now to FIGS. 1A-1C, FIGS. 1A and 1C show front side views and FIG. 1B is a perspective view of a non-limiting embodiment of display frame 100 according to the present disclosure. As shown in FIGS. 1A-1C, display frame 100 may include frame 102, insert 104, and holder 106. In some non-limiting embodiments, Insert 104 may be removably connected to frame 102. For example, FIG. 2 shows insert 104 removed from frame 102. FIGS. 1A and 1C show holder 106 in a closed position and FIG. 1B shows holder 106 in an open position. As shown in FIG. 1B, holder 106 may have first panel 108 hingedly connected to second panel 110. Accordingly, holder 106 may be herein referred to as hinged holder 106. As further shown in FIG. 1B, first panel 108 may be removably received within insert 104 and second panel 110 may be movable relative to first panel 108. The configuration of holder 104 is further shown and described below with reference to FIGS. 5A and 5B. In some non-limiting embodiments, holder 104 is configured to receive a card. In some non-limiting embodiments, a card may include a bi-fold card, a greeting card, a postcard, a photograph, or the like.

As further shown in FIGS. 1A-1C, insert 104 may be sized and configured to fit within frame 102. In some non-limiting embodiments, as shown in FIGS. 1A-1C, frame 102 and insert 104 may be mechanically fastened via friction fit. In other non-limiting embodiments, frame 102 and insert 104 may be mechanically fastened via one or more magnets, a hook and loop fastener, adhesive, or any combination thereof.

Referring now to FIG. 2, FIG. 2 shows a front side view of a non-limiting embodiment of insert 104 of display frame 100 according to the present disclosure. As shown in FIG. 2, insert 104 may have first surface 212. As further shown in FIG. 2, first surface 212 of insert 104 may include recess 214. In some non-limiting embodiments, recess 214 may be configured to removably receive first panel 108 of holder 106. In some non-limiting embodiments, recess 214 and first panel 108 may be mechanically fastened via friction fit, one or more magnets (e.g., magnets 528 as shown in FIG. 5B), a hook and loop fastener, adhesive, or any combination thereof.

Figure 3:
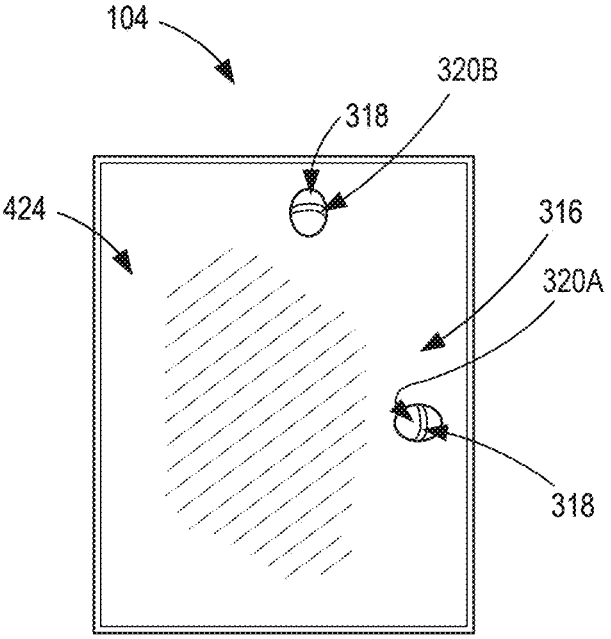
FIG. 3 shows a back side view of a non-limiting embodiment of an insert of a display frame according to the present disclosure.

Referring now to FIG. 3, FIG. 3 shows a back side view of a non-limiting embodiment of insert 104 of display frame 100 according to the present disclosure. As shown in FIG. 3 insert 104 may include at least two holding components 318A, 318B. In some non-limiting embodiments, as further shown in FIG. 3, insert 104 may include second surface 316, and second surface 316 may include at least two holding components 318A, 318B.

In some non-limiting embodiments, at least two holding components 318A, 318B may be configured to attach to wall fasteners. In some non-limiting embodiments, display frame 100 may be attached to a wall via wall fasteners. Further, in some non-limiting embodiments, display frame 100 attached to a wall via wall fasteners may define a first state. Wall fasteners may be, for example, screws, nails, hooks, or the like which may be used to hang pictures, frames, or the like to a wall or other surface. A front side view of display frame 100 in a first state according to the present disclosure, as if attached to a wall, can be seen in FIGS. 1A and 1B.

In some non-limiting embodiments, as further shown in FIG. 3, at least two holding components 318A, 318B may include slot 320A, 320B. Accordingly, at least two holding components 318A, 318B may be herein referred to as at least two slotted holding components 318A, 318B.

Referring now to FIG. 4A, FIG. 4A shows a back side view of a non-limiting embodiment of insert 104 of display frame 100 according to the present disclosure. As shown in FIG. 4A, insert 104 may include storage compartment 422. In some non-limiting embodiments, storage compartment 422 may be configured to store and conceal one or more cards. FIG. 4A shows storage compartment 422 in a closed position. In some non-limiting embodiments, insert 104 may further include removable backing 424 (e.g., as shown in FIG. 4B).

Referring now to FIG. 4B, FIG. 4B shows a non-limiting embodiment of removable backing 424 of an insert of a display frame according to the present disclosure. In some non-limiting embodiments, where display frame 100 includes removable backing 424, removable backing 424 may include second surface 316 and removable backing 424 may further include any or all of the features of second surface 316 as shown and described herein. Accordingly, in some non-limiting embodiments, removable backing 424 may include at least two holding components 318A, 318B.

In some non-limiting embodiments, where display frame 100 includes removable backing 424, removable backing 424 may be mechanically fastened to insert 104 (e.g., as shown in FIG. 3). In some non-limiting embodiments, removable backing 424 may be mechanically fastened to insert 104 via friction fit, one or more magnets (e.g., one or more magnets 426 as shown in FIG. 4B), a hook and loop fastener, adhesive, or any combination thereof.

Referring now to FIGS. 4C and 4D, FIGS. 4C and 4D show back side views of a non-limiting embodiment of insert 104 of a display frame 100 with storage compartment 422 in an open position according to the present disclosure. FIG. 4D further shows card C in storage compartment 422.

Figure 5A:
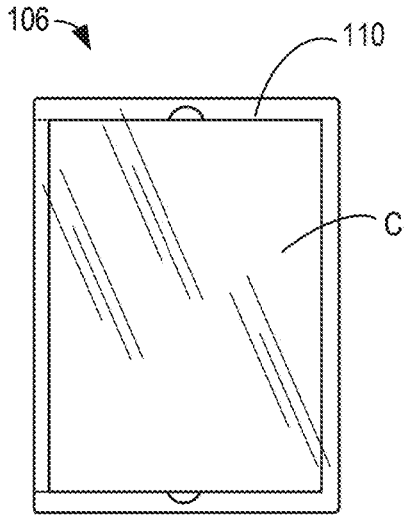
FIG. 5A shows a front side view of a non-limiting embodiment of a holder of a display frame in a closed position according to the present disclosure.
Figure 5B:
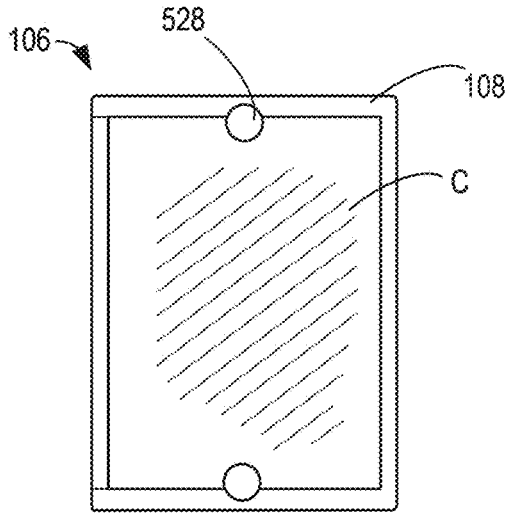
FIG. 5B shows a back side view of a non-limiting embodiment of a holder of a display frame in a closed position according to the present disclosure.
Figure 5C:
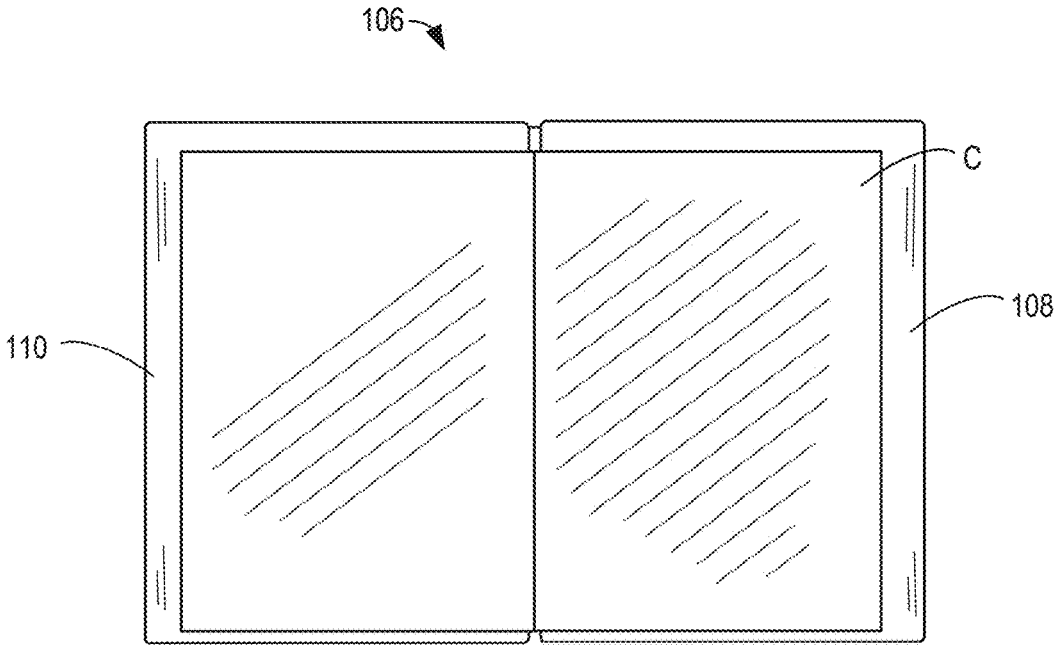
FIG. 5C shows a non-limiting embodiment of a holder of a display frame in an open position according to the present disclosure.

Referring now to FIGS. 5A-5C, FIGS. 5A and 5B are a front side view and a back side view of a non-limiting embodiment of holder 106 of display frame 100 in a closed position, and FIG. 5C shows a non-limiting embodiment of holder 106 of display frame 100 in an open position, according to the present disclosure. As shown in FIGS. 5A-5C, holder 106 (hinged holder 106) may be hinged, and may include first panel 108 and second panel 110. As further shown in FIGS. 5A-5C, first panel 108 may be sized and configured to receive a first portion of card C, and second panel 110 may be sized and configured to receive a second portion of card C. In some non-limiting embodiments, holder 106 is translucent and allows a card such as a bi-fold card, a greeting card, a postcard, a photograph, or the like to be seen through the holder.

In some non-limiting embodiments, as shown in FIG. 5B, holder 106 may include one or more magnets 528, and recess 214 of insert 104 (as shown in FIG. 2) and first panel 108 may be mechanically fastened via one or more magnets 528. In some non-limiting embodiments, recess 214 and first panel 108 may be mechanically fastened via friction fit, a hook and loop fastener, adhesive, or any combination thereof.

Figure 6A:
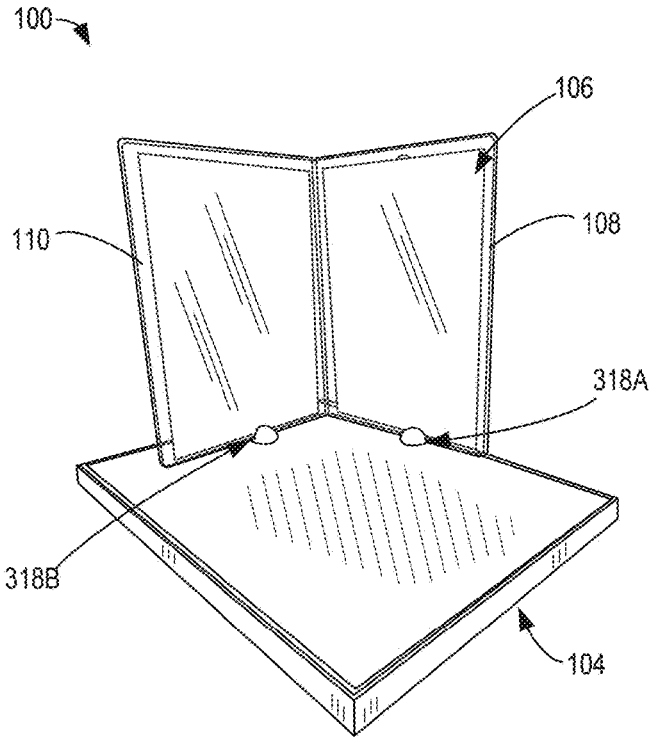
FIG. 6A shows a perspective view of a non-limiting embodiment of a display frame in second state according to the present disclosure.
Figure 6B:
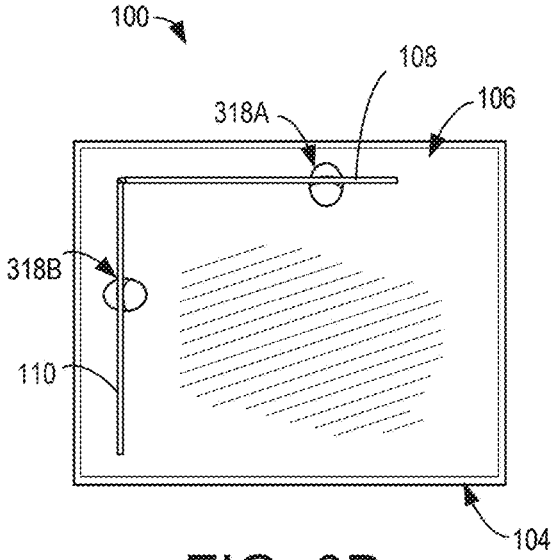
FIG. 6B shows a plan view of a non-limiting embodiment of a display frame in second state according to the present disclosure.
Figure 6C:
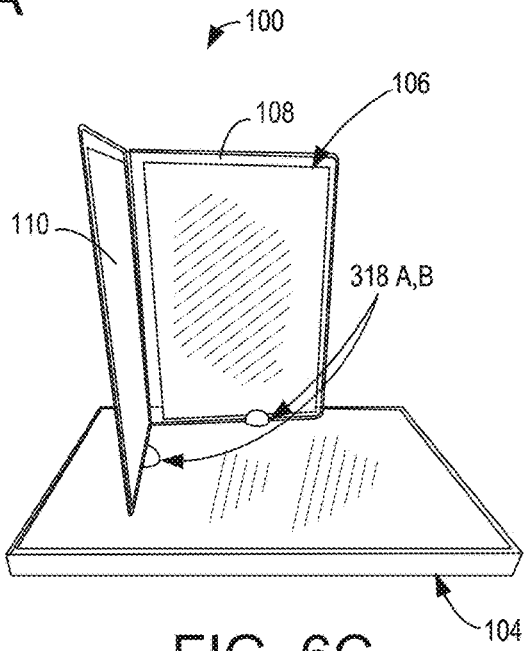
FIG. 6C shows a perspective view of a non-limiting embodiment of a display frame in second state according to the present disclosure.

Referring now to FIGS. 6A-6C, FIGS. 6A and 6B show perspective views and FIG. 6B shows a plan view of a non-limiting embodiment display frame 100. As shown in FIGS. 6A-6C, at least two slotted holding components 318A, 318B may be further configured to hold holder 106 in an upright position when insert 104 is in a horizontal position. As further shown in FIGS. 6A-6C, first slotted holding component 318A of at least two slotted holding components 318A, 318B may be configured to hold first panel 108 of hinged holder 106 in an upright position, and second slotted holding component 318B of at least two slotted holding components 318A, 318B may be configured to hold second panel 110 of hinged holder 106 in an upright position.

In some non-limiting embodiments, as shown in FIGS. 6A-6C, insert 104 of display frame 100 is in a horizontal position and holder 106 is held in an upright position by at least two slotted holding components 318A, 318B may define a second state.

Figure 7A:
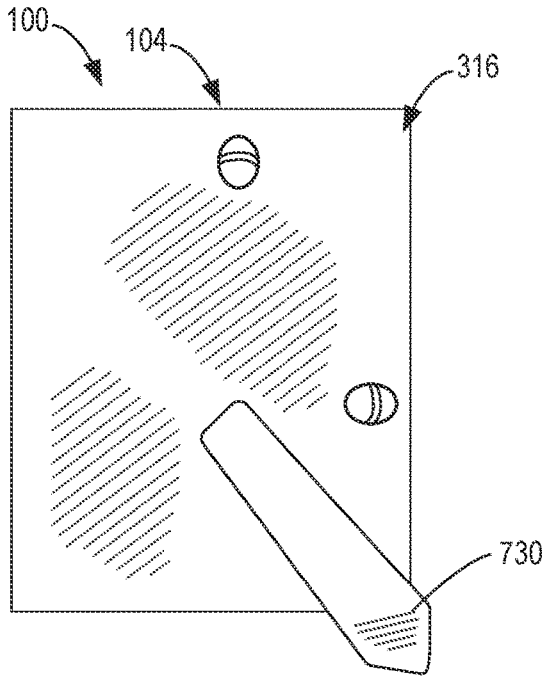
FIG. 7A shows a back side view of a non-limiting embodiment of a display frame according to the present disclosure.

Referring now to FIG. 7A, FIG. 7A shows a back side view of a non-limiting embodiment of display frame 100 according to the present disclosure. As shown in FIG. 7A, display frame 100 may include hinged easel back 730. In some non-limiting embodiments, hinged easel back 730 may be configured to hold display frame 100 in an upright position on a horizontal surface. In some non-limiting embodiments, second surface 316 of insert 104 may further include hinged easel back 730 configured to hold display frame 100 in an upright position on a horizontal surface.

Figure 7B:
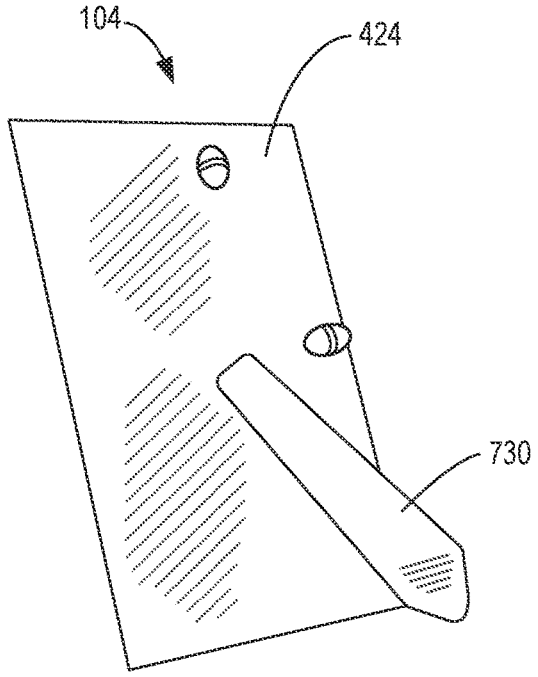
FIG. 7B shows a perspective view of a non-limiting embodiment of an insert of a display frame according to the present disclosure.

Referring now to FIG. 7B, FIG. 7B shows a perspective view of a non-limiting embodiment of insert 104 of a display frame 100 according to the present disclosure. As shown in FIG. 7B, removable backing 424 may include hinged easel back 730 configured to hold display frame 100 in an upright position on a horizontal surface.

Figure 7C:
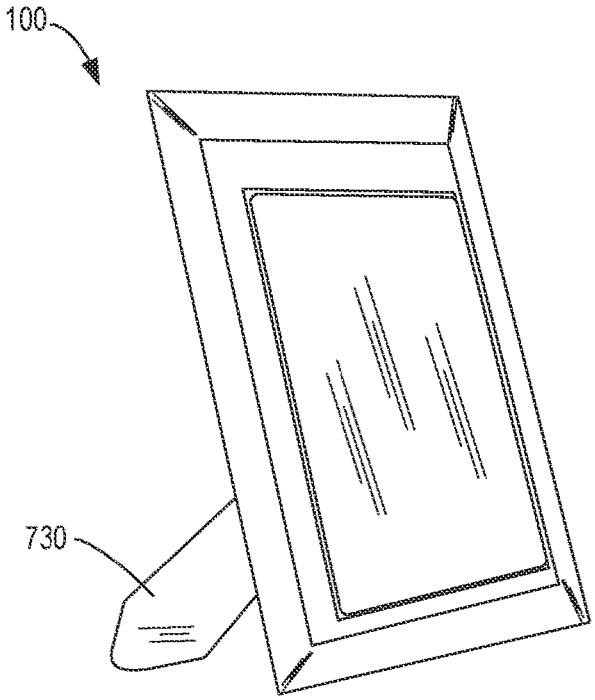
FIG. 7C shows a perspective view of a non-limiting embodiment of a display frame according to the present disclosure.
Figure 8:
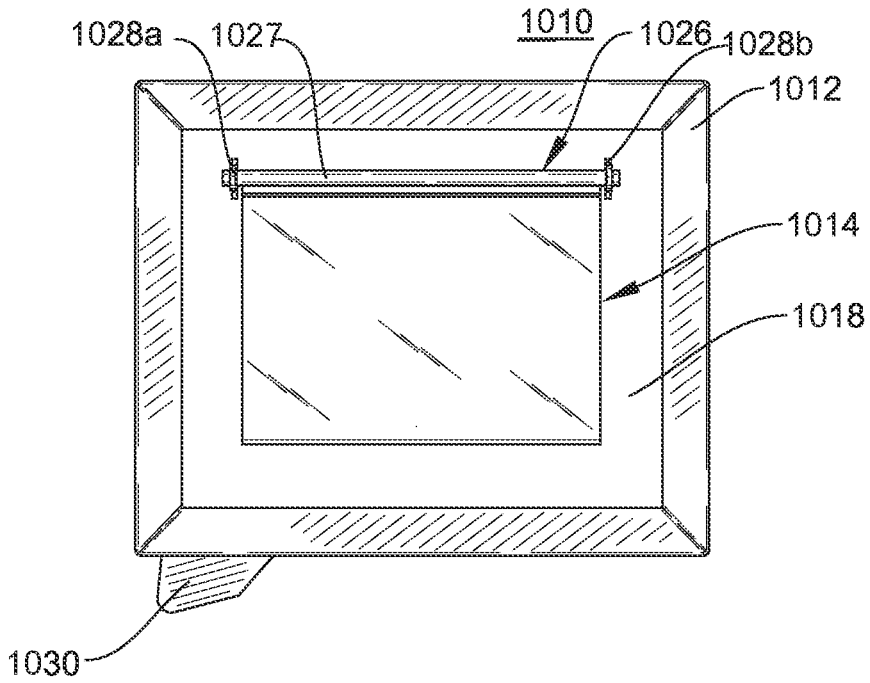
FIG. 8 shows an exemplary front plan view of a non-limiting embodiment of a hinged display frame according to the present disclosure.
Figure 9:
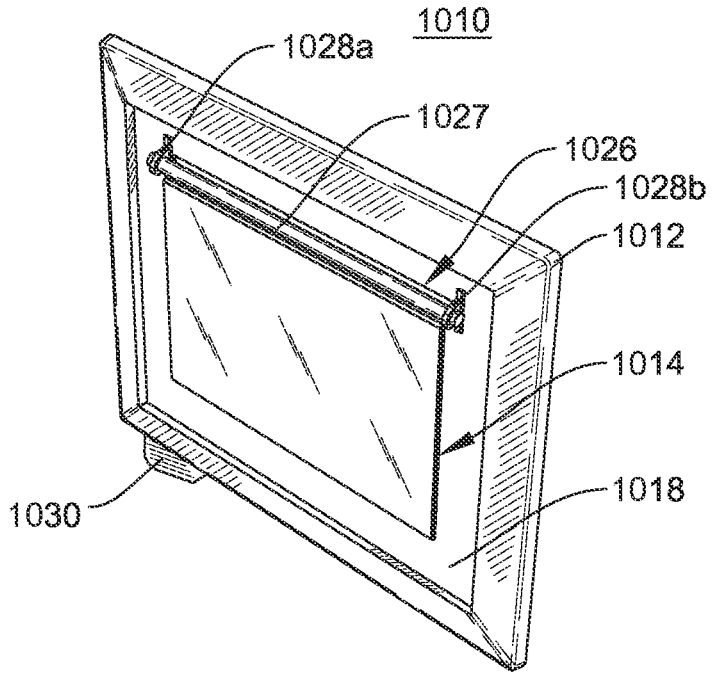
FIG. 9 shows an exemplary front perspective view of a non-limiting embodiment of the hinged display frame according the present disclosure.
Figure 10:
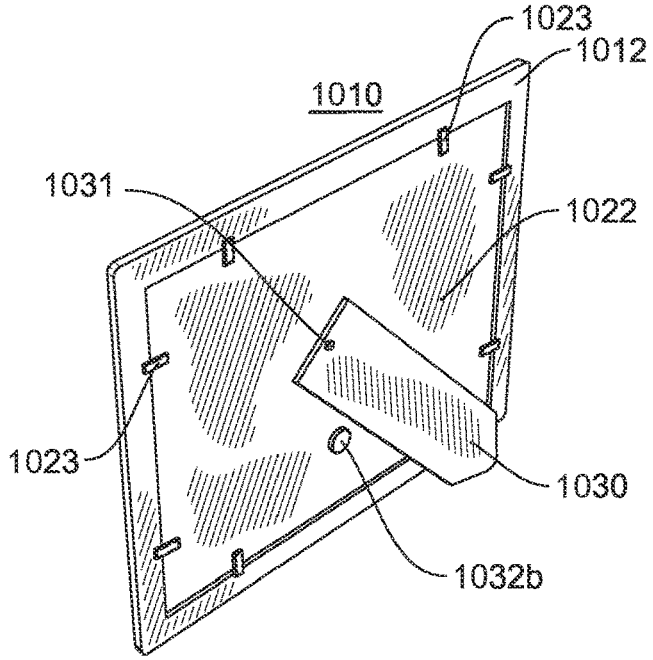
FIG. 10 shows an exemplary rear plan view of a non-limiting embodiment of the hinged display frame according to the present disclosure.
Figure 11:
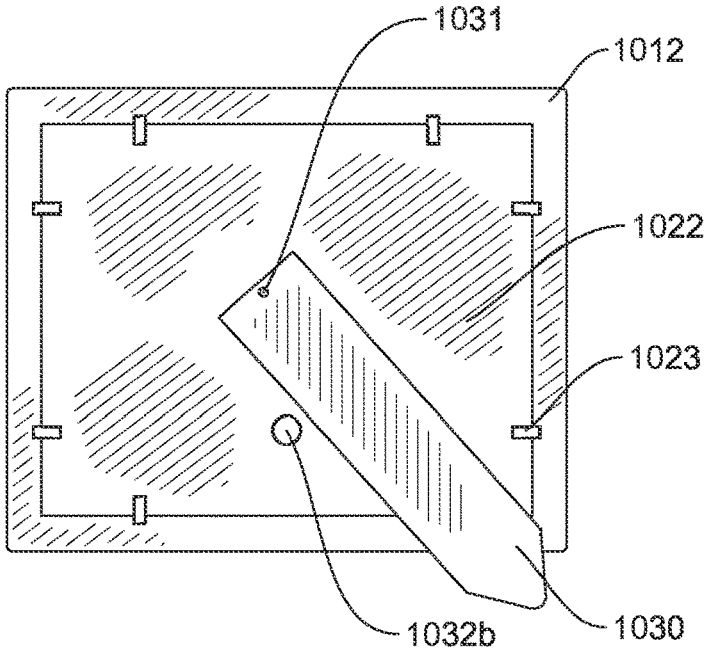
FIG. 11 shows an exemplary rear perspective view of a non-limiting embodiment of the hinged display frame according to the present disclosure.
Figure 12:
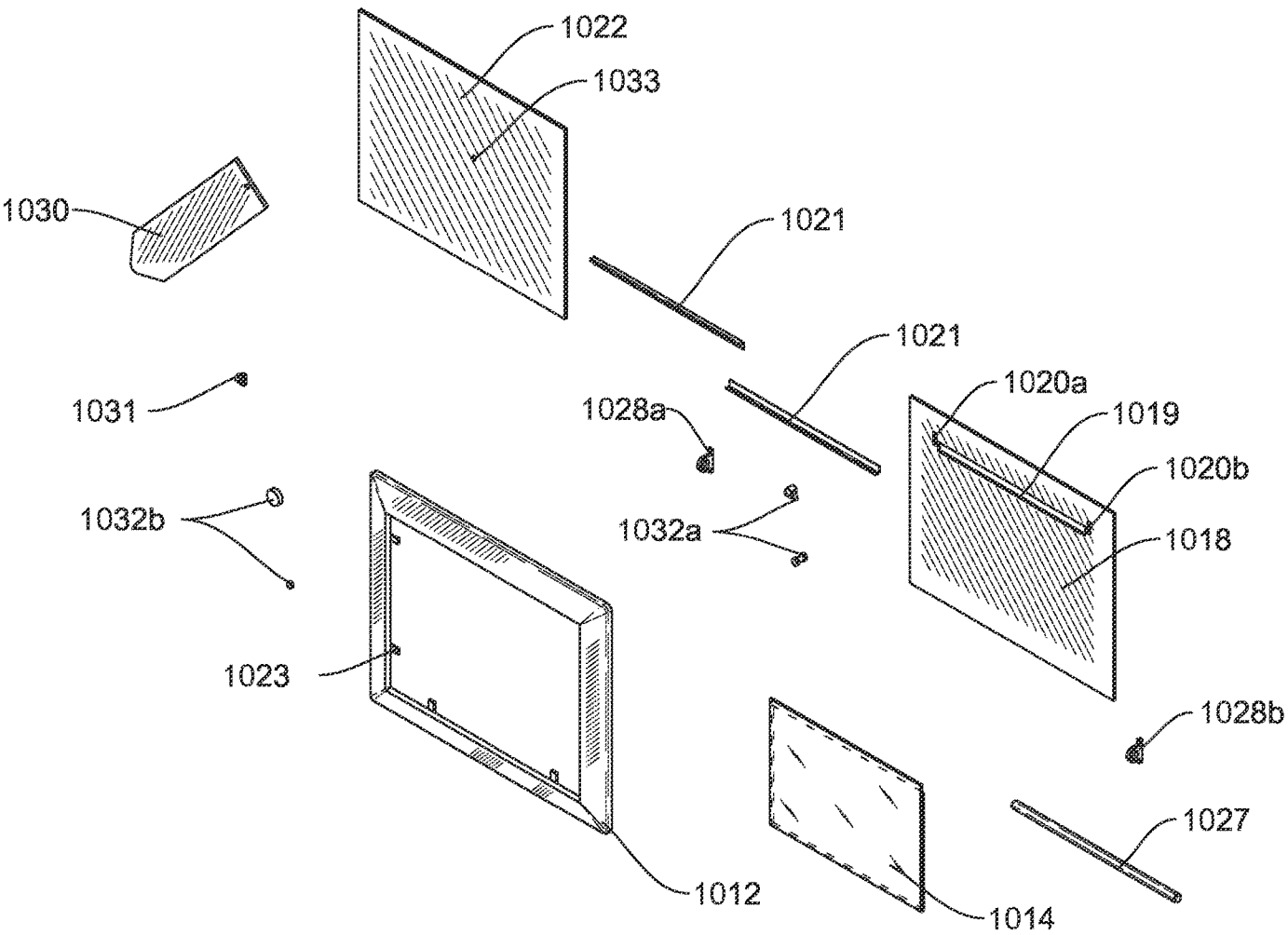
FIG. 12 shows an exemplary exploded view of a non-limiting embodiment of the hinged display frame according to the present disclosure.

Referring now to FIG. 7C, FIG. 7C shows a perspective view of a non-limiting embodiment of display frame 100 according to the present disclosure. In some non-limiting embodiments, as shown in FIG. 7C, display frame 100 held in an upright position on a horizontal surface by easel back 730 may define a third state.

In some non-limiting embodiments, a display frame such as display frame 100 may include an additional removable backing. The additional removable backing may include an easel back such as easel back 730, and the easel back may be configured to hold the display frame in an upright position on a horizontal surface. In some non-limiting embodiments, the additional backing may be may be mechanically fastened to a frame such as frame 102. In some non-limiting embodiments, the additional removable backing may be mechanically fastened to an insert such as insert 104.

Additional embodiments described herein are directed to a hinged display frame device ("the device") for a greeting card. The device allows individuals to properly display, protect and preserve a card that contains a personal message, while still allowing the card to function in its intended purpose. For example, a birthday card from an aging parent to a child that ended up being the last card the child ever received before said parent's passing. A card such as this is priceless to the recipient. Often times people save these meaningful cards, but don't have a proper way to display them, so they end up in a drawer, or lost. The device is made of a durable material which protects an enclosed card from being damaged and the device includes a hinged flap which can be opened to open an enclosed greeting card.

Figure 15:
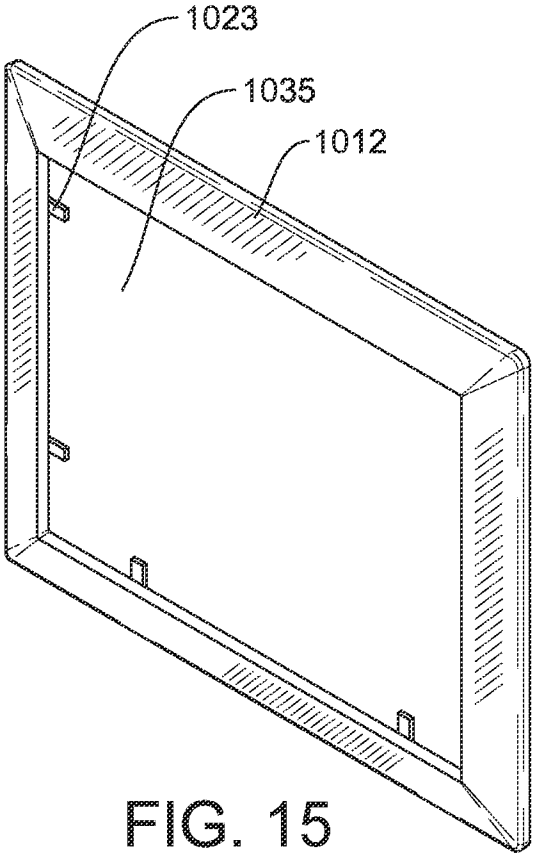
FIGS. 13-15 show various exemplary views of a non-limiting embodiment of the frame housing structure of the hinged display frame according to the present disclosure.
Figure 14:
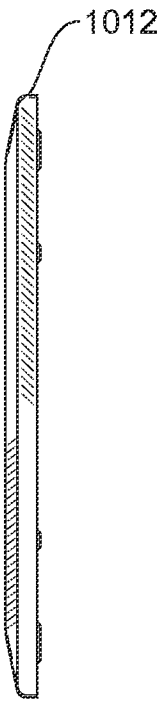
Figure 13:
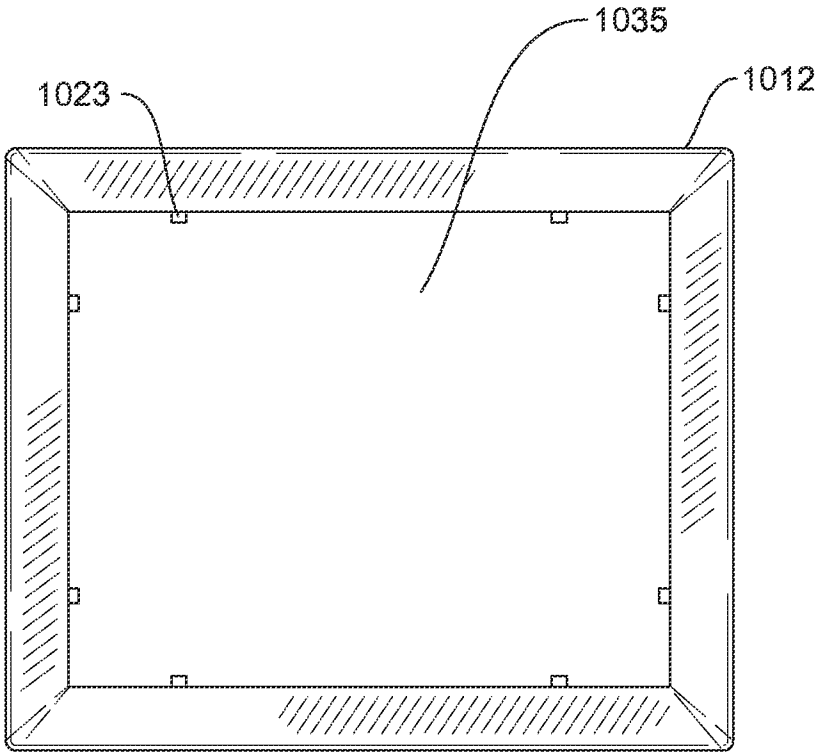

Turning to FIGS. 8-12, the device 1010 includes a housing 1012, a flap 1014, a front cover 1018, a rear cover 1022, a hinge assembly 1026, and a display leg 1030. The housing (e.g., molding) encloses the front cover 1018, an object desired to be displayed (e.g., greeting card), and the rear cover 1022. The housing includes a cutout region 1035 which is the display region of the device 1010. The housing 1012, which is illustrated in further detail in FIGS. 13-15, includes at least one notch extending along the perimeter of the inner facing surface of the housing for receiving front cover 1018. Additionally, the at least one notch may receive rear cover 1022. In other aspects, the housing may include a separate notch extending along the perimeter of the inner facing surface of the housing for receiving the rear cover 1022. The housing may include a plurality of fasteners 1023 (e.g., turn buttons, metal tabs or flexi-points) along its outer most rear surface to secure attachment of the rear cover 1022 to the housing. The housing 1012 may be made from any suitable rigid material, such as, for example, metal, wood, etc.

Figure 18:
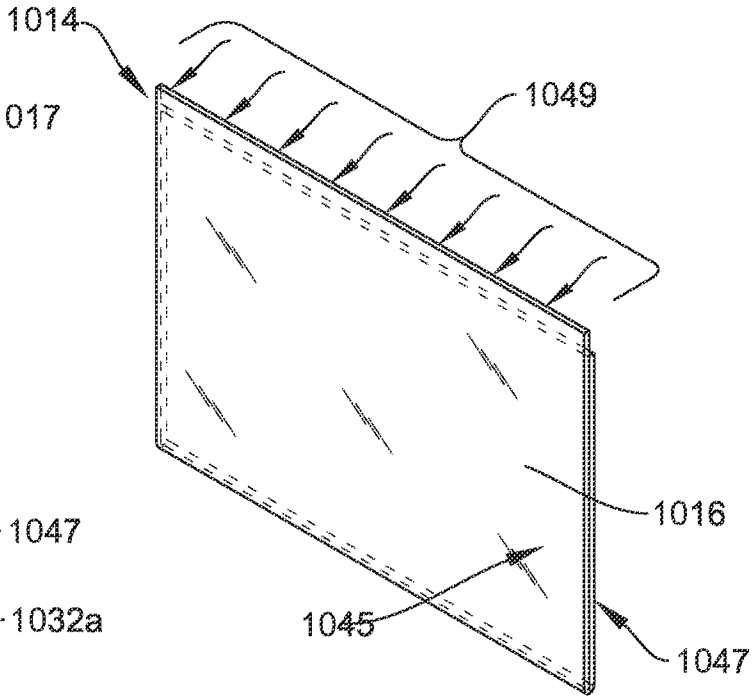
FIGS. 16-18 show various exemplary views of a non-limiting embodiment of the flap structure of the hinged display frame according to the present disclosure.
Figure 17:
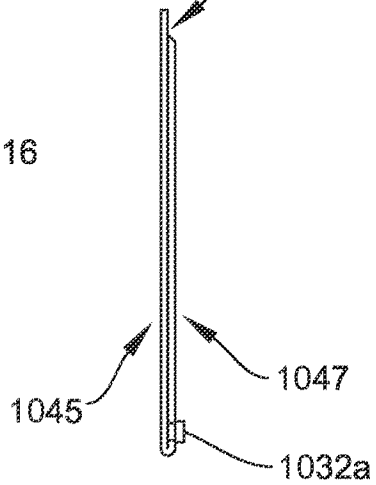
Figure 16:
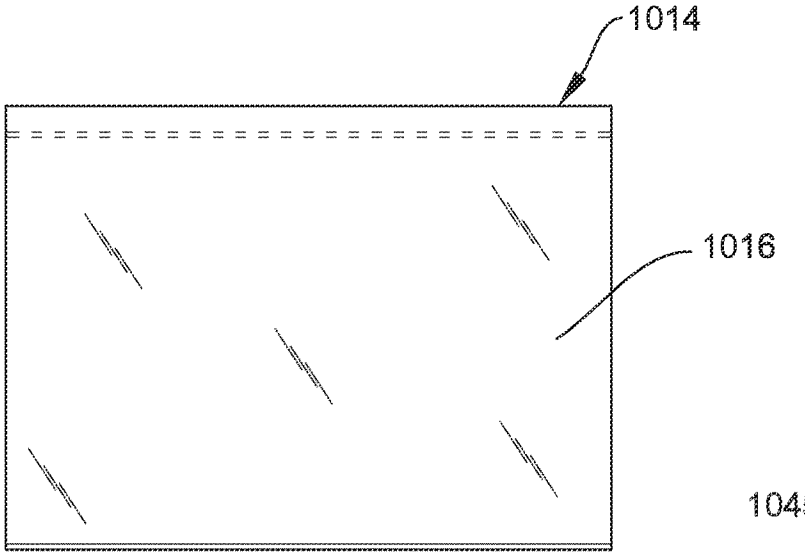
Figure 21:
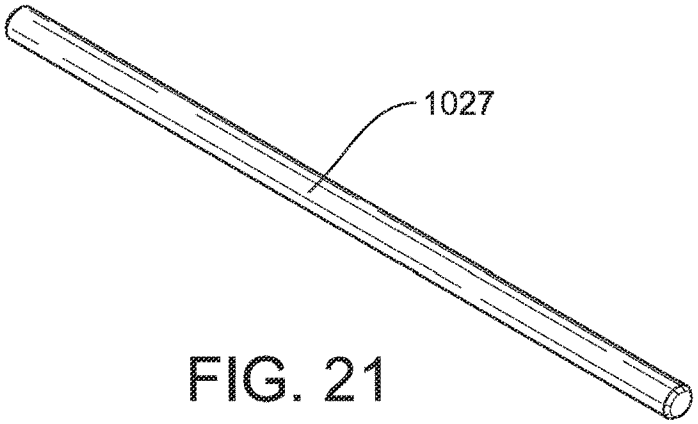
FIGS. 19-24 show various exemplary views of a non-limiting embodiment of the hinge assembly structure of the hinged display frame according to the present disclosure.
Figure 24:
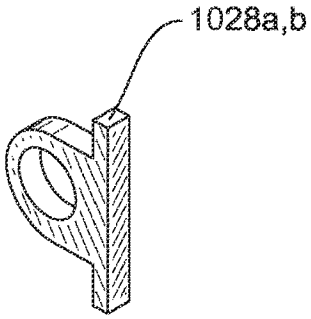
Figure 19:
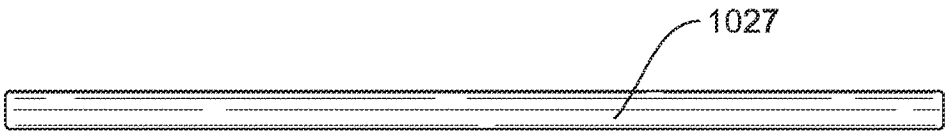
Figure 20:
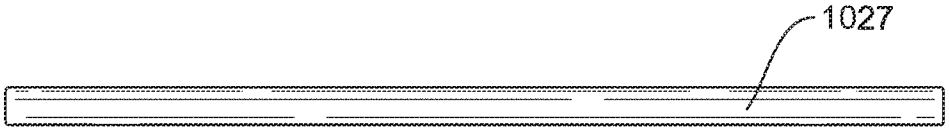
Figure 23:
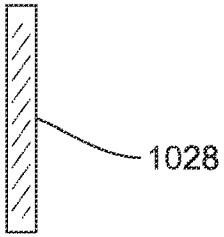
Figure 22:
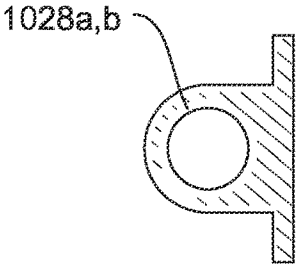

The flap 1014 operates as a first display mechanism for an object (e.g., the front cover and the left side of a greeting card). The flap has a front side 1045 and a back side 1047 and each side may display an aspect of an enclosed object. For example, the front side 1045 may display the front cover of a greeting card and the back side 1047 may display the left side of the inside contents of the greeting card. The front side 1045 of the flap 1014 is taller than the rear side 1047 of the flap (see FIG. 18). The flap is transparent and is made of a durable material, such as, for example, acrylic or glass, to protect the displayed object (e.g., a greeting card) from physical damage. In some aspects, the flap 1014 and the front cover 1018 are made of the same material. In other aspects, the flap and the front cover are made of different materials.

The flap 1014 is attached to the front cover 1018 by way of hinge assembly 1026, illustrated in FIGS. 19-24. The hinge assembly includes a pair of hinges 1028*a* and 1028*b* and a cylindrical bar/rod 1027. The bar 1027 is fixedly attached to the flap 1014, and more specifically, the bar attaches along the top edge of the rear surface (identified as 1049) of the front side of the flap. When the bar 1027 is attached to hinges 1028*a* and 1028*b*, the bar is positioned immediately above the top edge 1037 of horizontal opening 1019. The bar is positioned above the opening 1019 so as not to interfere (by blocking the open space) with the insertion of the left side of the greeting card into the opening and into enclosure 1016 of the flap. The hinge assembly 1026 allows the flap to operate in an open position (by rotating the flap upwards in a north direction) and a closed position by rotating the flap (which is in an open position) downwards in south direction. The default position of the flap is in a closed position.

Turning to FIGS. 16-18 and 34-35, the flap 1014 includes an enclosure/cavity 1016 for storing an object (e.g., one side of a greeting card). The top of the flap has an opening 1017 which leads into enclosure 1016. The opening 1017 allows the greeting card (one side of the card) to slide into enclosure 1016. Moreover, the flap includes a magnet (e.g., magnet 1032*a*) on its rear side 1047, which mates with another (e.g., magnet 1032*b* located on the rear surface of the rear cover 1022) to keep the flap flushed against the front cover (i.e., in a closed position). The rear side 1047 of flap 1014 rests on the front surface of the front cover 1018.

The front cover 1018 operates as a second display mechanism for an object (e.g., the left side of a greeting card). The front cover protects the displayed object (e.g., a greeting card enclosed in device 1010) (from the front side of the device 1010) from physical damage. The front cover may be inserted into at least one notch within housing 1012, and more particularly, the outer edges of the front cover may be inserted into the at least one notch. The front cover is transparent and is made of a durable material, such as, for example, acrylic or glass, to protect the displayed object (e.g., a greeting card) (from the front side of the device 1010) from dust or physical damage and still permit the card to be viewed. The front cover also provides protection to the displayed object from humidity and condensation. An object desired for display, such as, for example, a greeting card (e.g., one side of the greeting card) may be inserted in the at least one notch and positioned adjacent to the front cover 1018. Moreover, the greeting card (e.g., one side of the greeting card) may be sandwiched between the front cover 1018 and the rear cover 1022.

Figure 26:
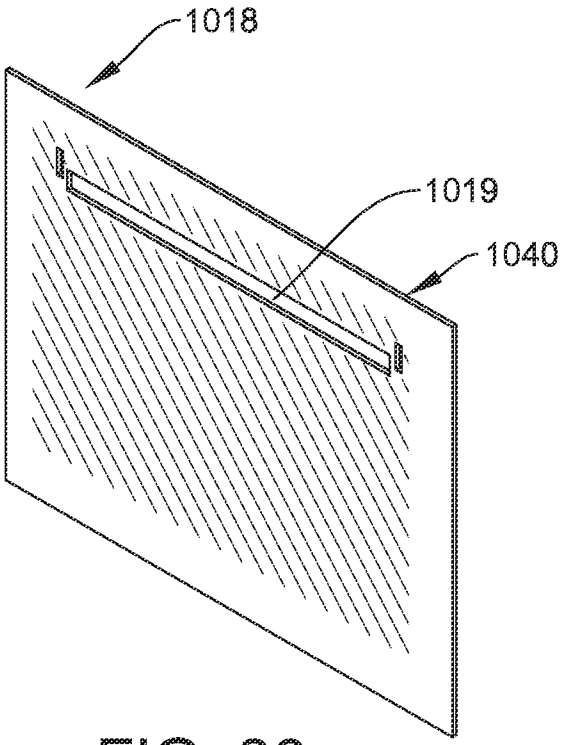
FIGS. 25-26 show various exemplary views of a non-limiting embodiment of the front cover structure of the hinged display frame according to the present disclosure.
Figure 25:
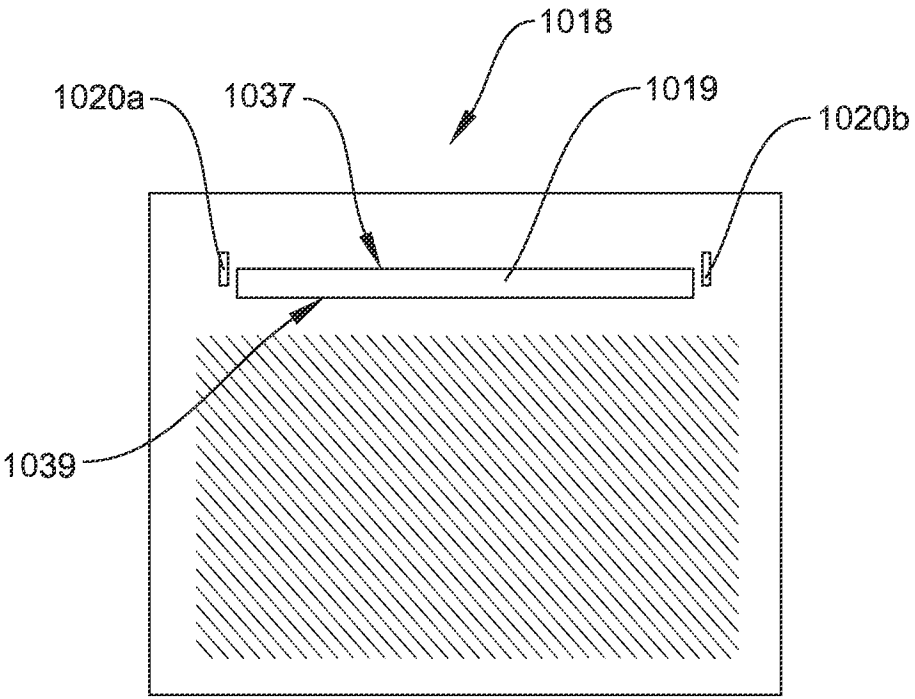

The front cover 1018, which is illustrated in further detail in FIGS. 25-26 includes a horizontal opening 1019 (i.e., the opening is positioned in a horizontal direction relative to the top edge 1040 of the front cover) and two vertical openings 1020*a*, and 1020*b* (each opening is positioned in a vertical direction relative to the top edge 1040 of the front cover). The horizontal opening may be positioned in a parallel manner near the top edge 1040 of the front cover 1018. Each vertical opening 1020*a*, 1020*b* is positioned at opposite sides of the horizontal opening, and extends upward in a direction away from the top edge 1037 of the horizontal opening and to a distance higher than the top edge of the horizontal opening. The two vertical openings are each configured to receive a corresponding hinge (1028*a*, 1028*b*) of hinge assembly 1026, and each hinge is configured to receive one end of bar 1027 of hinge assembly 1026. When the bar is attached to the hinges (1028*a*, 1028*b*) at both ends, and the hinges are attached to a corresponding vertical opening 1020*a*, 1020*b*, the bar 1027 is positioned horizontally to and immediately above the top edge 1037 of horizontal opening 1019. In this configuration, an enclosed greeting card is displayed horizontally in the display region 1035 of the housing 1012.

In other aspects, the front cover may include a vertical opening (i.e., the opening is positioned in a vertical direction relative to the top edge 1040 of the front cover) with two horizontal openings at each end of the vertical opening (each opening is positioned in a horizontal direction relative to the top edge 1040 of the front cover), instead of the horizontal opening with two vertical openings. The vertical opening may be positioned near a left side or right side of the front cover in a perpendicular manner relative to the top edge 1040 of the front cover. In this configuration, when hinges 1028*a* and 1028*b* are each attached to a corresponding horizontal opening and bar 1027 is attached to hinges 1028*a* and 1028*b*, the bar 1027 would be positioned immediately left of the vertical opening. To this end, an enclosed greeting card is displayed vertically in the display region of the housing 1012.

The rear cover 1022 (e.g., a backing board) protects the displayed object (e.g., an enclosed greeting card) from the backside of the device 1010. The rear cover may be inserted into the at least one notch or another notch within housing 1012, and may be constructed from cardboard, standard foam board, acid free foam board, mat board, hard board, chip board, easel backs, or wood. The rear cover includes an aperture 1033 for attachment of a leg 1030. The leg 1030 (illustrated in FIGS. 29-33) may be attached to the aperture 1033 with a fastener 1031. In a preferred embodiment, leg 1030 is a hinged leg and is attached to the rear cover with a hinge fastener. The leg when extended out from the rear cover allows the device to stand upright as a display.

Figure 27:
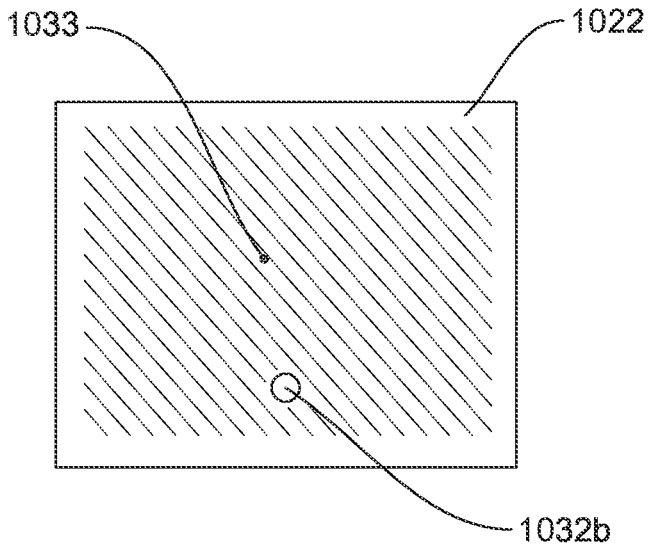
FIGS. 27-28 show various exemplary views of a non-limiting embodiment of the rear cover structure of the hinged display frame according to the present disclosure.
Figure 28:
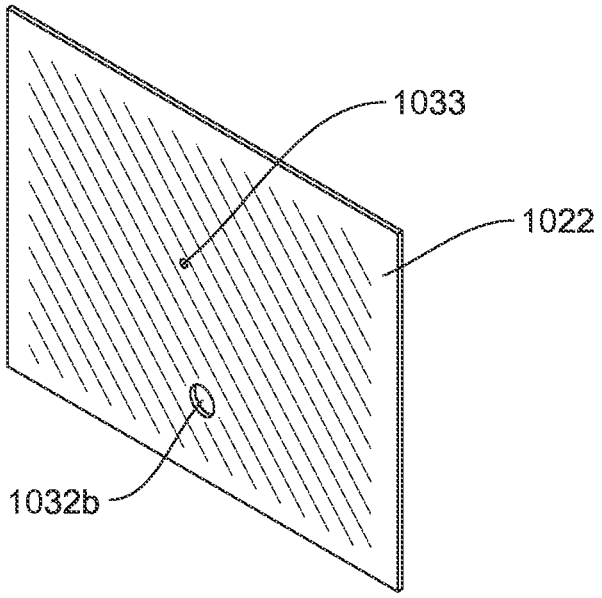
Figure 29:
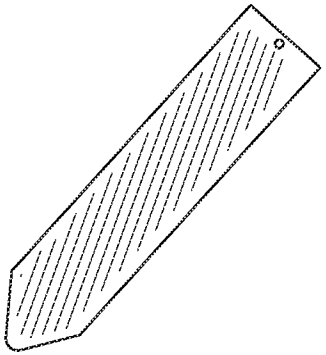
FIGS. 29-33 show various exemplary views of a non-limiting embodiment of the leg structure of the hinged display frame according to the present disclosure.
Figure 30:
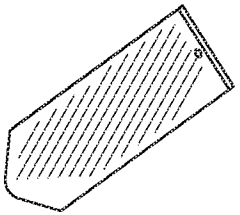
Figure 31:
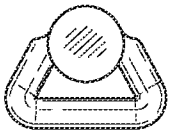
Figure 32:
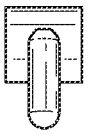
Figure 33:
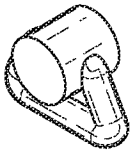
Figure 34:
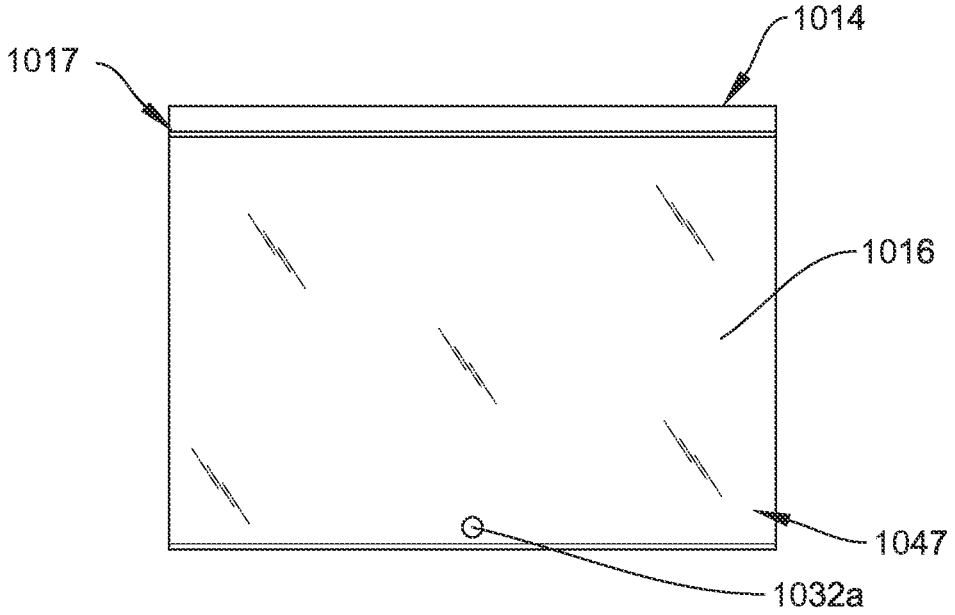
FIG. 34 shows an exemplary rear view of a non-limiting embodiment of the flap structure of the hinged display frame according to the present disclosure.
Figure 35:
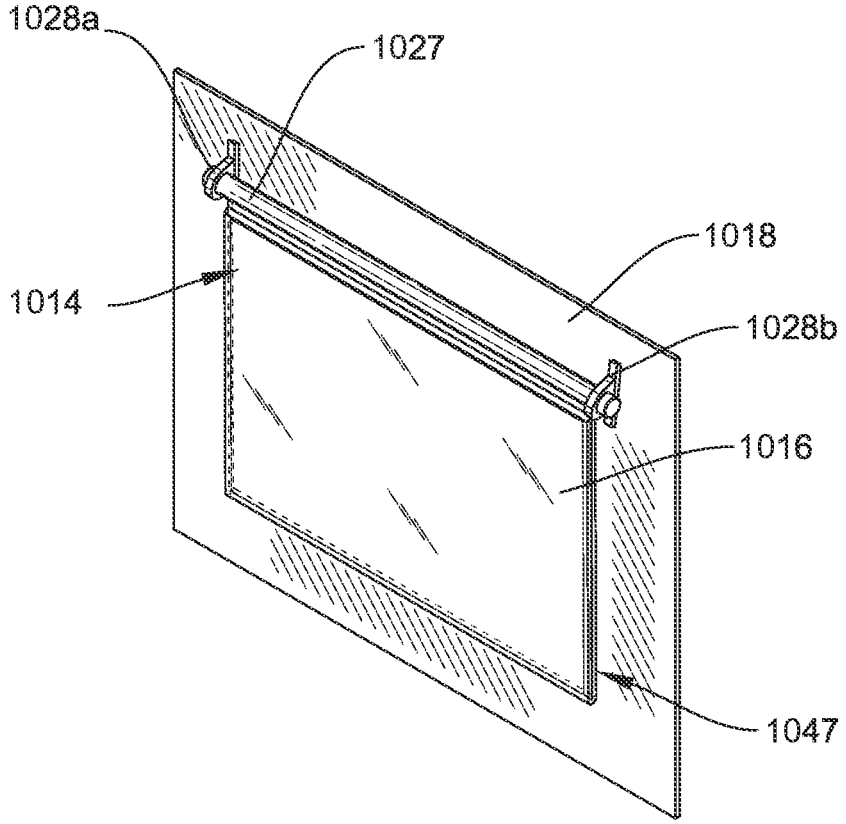
FIG. 35 shows an exemplary view of a non-limiting embodiment of the flap structure attached to the front cover of the hinged display frame according to the present disclosure.

Moreover, the rear cover, which is illustrated in further detail in FIGS. 27-28, includes a magnet 1032*b* which mates with magnet 1032*a* which is located on flap 1014. The magnet pair (1032*a* and 1032*b*) keep the flap 1014 flushed against the front cover 1018 when the flap is in a closed position. The magnet pair operate to pull towards one another thereby keeping the flap closed unless a stronger force is applied to the flap, which occurs when the flap is opened manually.

The device 1010 is configured to enclose an object for display (e.g., a greeting card or photo or any other suitable object). In a preferred embodiment, the device may enclose a greeting card. The greeting card may be constructed as a unitary structure made out of card stock with a middle fold (i.e., crease or score) which forms a greeting card having a front side, an inside (having a left side and a right side relative to the crease), and a back/rear side. The device 1010 is configured to display the front cover and the inside of the greeting card, including both the left side and the right side.

In an exemplary embodiment, one side of the greeting card (e.g., the right side of the card relative to the crease of the card) is positioned horizontally and adjacent to the front cover so that the crease (i.e., the fold) of the greeting card is positioned relatively parallel with the bottom edge 1039 of the horizontal opening 1019 or is positioned on top of the bottom edge 1039 of the horizontal opening 1019.

The device 1010 may be formed by inserting the front cover 1018 in the at least one notch in the housing 1012, sliding the left side of a greeting card through the opening (e.g., horizontal opening 1019) in the front cover 1018 and into the enclosure 1016 of flap 1014, and inserting the rear cover 1022 immediately behind the right side of the greeting card and into a notch in the housing 1012. The flap 1014 may be rotated upwards, if necessary, to insert the right side of the greeting card into the enclosure 1016. The right side of the greeting card is positioned immediately behind the front cover 1018. The rear cover may be secured to the housing 1012 by using fasteners 1023 which prevent the outer edges of the rear cover from sliding out of the notch/housing. Once assembled, the device 1010 displays the right side of the greeting card in the display region 1035 of the housing 1012, and the front cover and the left side of the greeting card are displayed on opposite sides respectively of flap 1014. The flap may rotate upward (e.g., north direction) and downward (e.g., south direction) so that the inside of the greeting card and the front cover are viewable.

Embodiments of the invention are discussed above with reference to the Figures. Although the disclosure has described the device used with a greeting card, the device may be used with other objects, such as, photos, other card stock objects, or any other suitable keepsake. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Moreover, those skilled in the art will appreciate from the foregoing description that the broad techniques of the embodiments of the present invention may be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

It should be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.)

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

What is claimed is:

1. A display frame for a card, the display frame comprising:

a frame;

an insert removably connectable to the frame; and a holder having a first panel hingedly connected to a second panel, wherein the first panel is removably received within the insert and the second panel is movable relative to the first panel, and wherein the insert comprises at least two holding components configured to hold the holder in an upright position when the insert is in a horizontal position.

2. The display frame of claim 1, wherein the holder is configured to receive a card.

3. The display frame of claim 2, wherein the frame and the insert are mechanically fastened via friction fit, one or more magnets, a hook and loop fastener, adhesive, or any combination thereof.

4. The display frame of claim 2, wherein the display frame further comprises a hinged easel back configured to hold the display frame in an upright position on a horizontal surface.

5. The display frame of claim 2, wherein the card comprises a bi-fold card, a greeting card, a postcard, a photograph, or any combination thereof.

6. The display frame of claim 1, wherein the insert comprises a first surface and a second surface, wherein the first surface comprises a recess configured to removably receive the first panel of the holder.

7. The display frame of claim 6, wherein the recess and the first panel of the holder are mechanically fastened via friction fit, one or more magnets, a hook and loop fastener, adhesive, or any combination thereof.

8. The display frame of claim 6, wherein the second surface comprises the at least two holding components, and the at least two holding components are configured to attach to wall fasteners when the display frame is attached to a wall defining a first state.

9. The display frame of claim 8, wherein when the at least two holding components hold the holder in an upright position when the insert is in a horizontal position defines a second state.

10. The display frame of claim 9, wherein the second surface further comprises a hinged easel back configured to hold the display frame in an upright position on a horizontal surface defining a third state.

11. The display frame of claim 6, wherein the insert comprises a storage compartment; and the insert further comprises a removable backing.

12. The display frame of claim 11, wherein the removable backing is mechanically fastened to the insert via friction fit, one or more magnets, a hook and loop fastener, adhesive, or any combination thereof.

13. The display frame of claim 12, wherein the removable backing comprises:

the at least two holding components, wherein the at least two holding components are configured to attach to wall fasteners when the display frame is attached to a wall defining a first state, and wherein when the at least two holding components hold the holder in an upright position when the insert is in a horizontal position defines a second state.

14. The display frame of claim 12, wherein the removable backing comprises a hinged easel back configured to hold the display frame in an upright position on a horizontal surface.

15. A display frame for a card, the display frame comprising:

a frame;

an insert sized and configured to fit within the frame, wherein the insert comprises at least two holding components; and a hinged holder sized and configured to hold a card, wherein the hinged holder having a first panel and a second panel, wherein a first holding component of the at least two holding components is configured to hold the first panel of the hinged holder in an upright position, and wherein a second holding component of the at least two holding components is configured to hold the second panel of the hinged holder in an upright position.

16. The display frame of claim 15, wherein the at least two holding components comprise a slot.

17. The display frame of claim 15, wherein the insert further comprises a storage compartment configured to store and conceal one or more cards.

18. The display frame of claim 15, wherein the holding components are further configured to attach to wall fasteners.

19. The display frame of claim 15, wherein the display frame further comprises a hinged easel back configured to hold the display frame in an upright position on a horizontal surface.

20. A display frame for a card comprising:

a frame;

an insert sized and configured to fit within the frame, wherein the insert comprises:

a removable backing mechanically fastened to the insert;

a recess;

at least two slotted holding components; and a storage compartment configured to store and conceal one or more cards;

a hinged easel back;

a hinged holder sized and configured to hold a card, wherein the hinged holder comprises:

a first panel sized and configured to receive a first portion of a card; and a second panel sized and configured to receive a second portion of a card, wherein a first slotted holding component of the at least two slotted holding components having a first slot sized and configured to hold the first panel of the hinged holder in an upright position, wherein a second slotted holding component of the at least two slotted holding components having a second slot sized and configured to hold the second panel of the hinged holder in an upright position, and wherein the recess of the insert is configured to removably receive the first panel of the hinged holder.

* * * * *